US010214034B2

(12) United States Patent
Fujioka et al.

(10) Patent No.: US 10,214,034 B2
(45) Date of Patent: Feb. 26, 2019

(54) INKJET RECORDING DEVICE

(71) Applicant: Roland DG Corporation, Hamamatsu-shi, Shizuoka (JP)

(72) Inventors: Hidenori Fujioka, Hamamatsu (JP); David Goward, Hamamatsu (JP); Yoshihiro Nariyama, Hamamatsu (JP); Yuji Sakata, Hamamatsu (JP); Shinji Tabuchi, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/136,494

(22) Filed: Sep. 20, 2018

(65) Prior Publication Data

US 2019/0016160 A1 Jan. 17, 2019

Related U.S. Application Data

(63) Continuation of application No. 15/517,219, filed as application No. PCT/JP2016/063744 on May 9, 2016, now Pat. No. 10,105,972.

(30) Foreign Application Priority Data

Sep. 16, 2015 (JP) ..... 2015-182580

(51) Int. Cl.

| | |
|---|---|
| ***B41J 11/00*** | (2006.01) |
| ***B41J 3/28*** | (2006.01) |
| ***B41J 11/58*** | (2006.01) |
| *B41J 2/145* | (2006.01) |

(52) U.S. Cl.

CPC ..... *B41J 11/58* (2013.01); *B41J 3/28* (2013.01); *B41J 2/145* (2013.01)

(58) Field of Classification Search

CPC ..... B41J 11/58; B41J 3/28; H04N 1/0405; B65H 2405/1117

See application file for complete search history.

(56) References Cited

U.S. PATENT DOCUMENTS 6,637,858 B2 * 10/2003 Wotton ..... B41J 2/155 347/29

8,668,307 B2 * 3/2014 Lewartowski ..... B41J 25/001 347/37

OTHER PUBLICATIONS

Fujioka et al., "Inkjet Recording Device", U.S. Appl. No. 15/517,219, filed Apr. 6, 2017.

* cited by examiner

*Primary Examiner* — Thinh H Nguyen

(74) *Attorney, Agent, or Firm* — Keating & Bennett, LLP

(57) ABSTRACT

An inkjet recording device allows a recording medium to be set easily, and prevents the recording medium from being warped so that printing quality is not lowered. An inkjet printer includes a bed including a surface that supports a recording medium, and a pivoting device that pivots the bed around a horizontal axis to locate the bed horizontally or vertically or pivots the bed around the horizontal axis to incline the bed with respect to a horizontal plane. The inkjet printer also includes a pair of guide rails provided on the bed and extending in an X direction and a movable member extending in a Y direction, engaged with the pair of guide rails and slidable on the pair of guide rails to move in the X direction.

13 Claims, 8 Drawing Sheets

INKJET RECORDING DEVICE

BACKGROUND OF THE INVENTION

1. Field of the Invention

The present invention relates to an inkjet recording device including a flatbed supporting a recording medium.

2. Description of the Related Art

Conventionally, an inkjet recording device using ink such as water soluble ink or the like is known. One type of such an inkjet recording device includes a flatbed platen supporting a recording medium (see, for example, Japanese Laid-Open Patent Publication No. 2007-98635). In Japanese Laid-Open Patent Publication No. 2007-98635, the flatbed platen is plate-shaped. The flatbed platen is located on an inclining front surface of a device main body. Thus, the flatbed platen is positioned in an inclining state.

To set a recording medium on the flatbed platen, the above-described conventional technology requires the recording medium to be raised such that the recording medium leans on the flatbed platen. It is not easy to set the recording medium in this manner. Therefore, an inkjet recording device allowing an operator to set the recording medium easily has been desired. In the case where the recording medium is formed of a material that is easily warped, the recording medium may be undesirably warped when being set on the flatbed platen. When injected toward such a warped recording medium, ink lands on the recording medium at a position shifted from a predetermined position. This causes a problem that the printing quality is lowered.

SUMMARY OF THE INVENTION

Preferred embodiments of the present invention provide inkjet recording devices allowing a recording medium to be set easily, and preventing the recording medium from being warped so that the printing quality is not lowered.

An inkjet recording device according to a preferred embodiment of the present invention includes a bed including a flat surface that supports a recording medium; an ink head that injects ink toward the recording medium on the bed; a table located below the bed; a leg that supports the table; and a pivoting device that pivots the bed and the ink head around a horizontal axis.

With an inkjet recording device according to a preferred embodiment of the present invention, the bed may be inclined at any angle with respect to a horizontal plane. This allows the bed to be located parallel or substantially parallel to the horizontal plane, or located to define a relatively small angle with respect to the horizontal plane, to set the recording medium to the bed. Therefore, the recording medium is easily set. This prevents the recording medium from being warped when the recording medium is set, and thus the printing quality is not lowered. For moving the inkjet recording device through a small space, the bed may be raised to decrease the width of the inkjet recording medium. This improves the ease of movement. In addition, the recording medium may be located at an appropriate angle in accordance with the recording medium, specifically, in accordance with the hardness of the recording medium. Therefore, when, for example, the recording medium is to be set on the bed inclined at a relatively large angle, the recording medium, even if being easily bendable (e.g., even if being paper or the like), is prevented from coming off from the bed. The "bed including a flat surface" encompasses any bed having a protruded surface or a recessed surface to such a degree that does not obstruct location of a recording medium thereon, for example, a bed having, for example, a seal pasted thereon to have a surface thereof protruded or a bed having a surface thereof recessed for the purpose of, for example, forming a pattern.

Preferred embodiments of the present invention provides inkjet recording devices that allow a recording medium to be set easily, and prevent the recording medium from being warped so that the printing quality is not lowered.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1A:
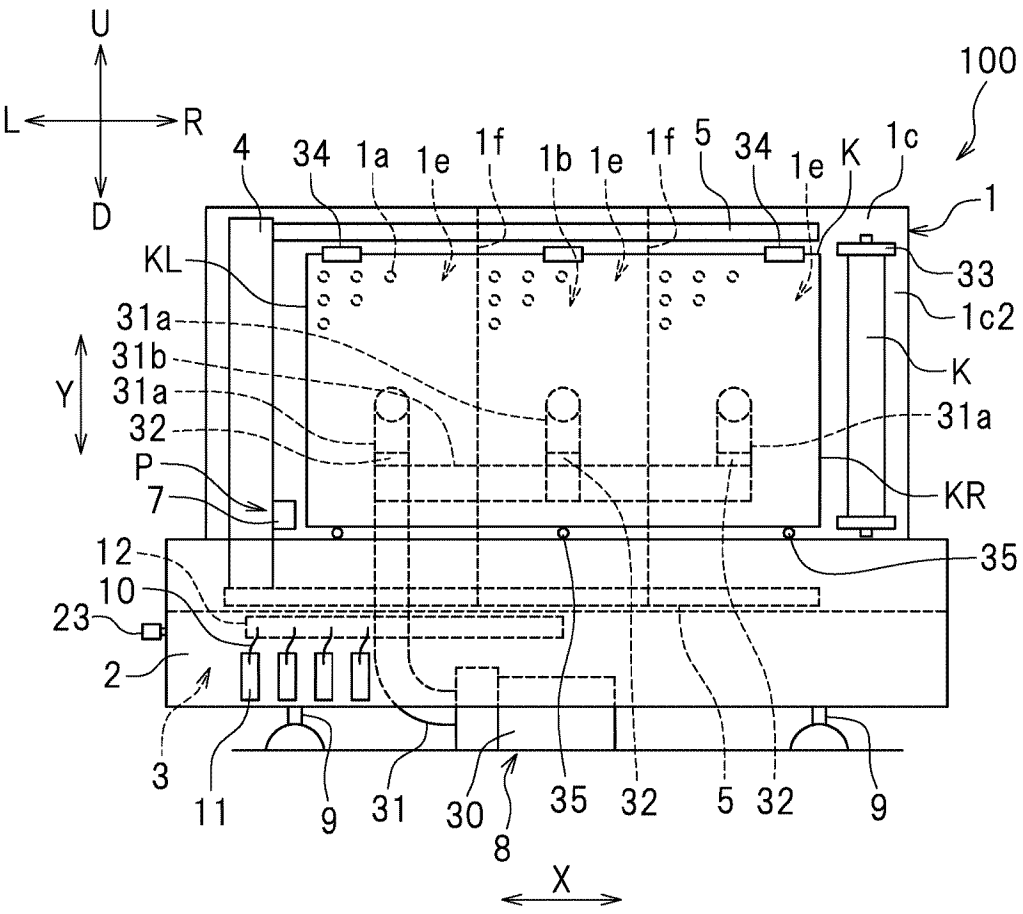
FIG. 1A is a front view of an inkjet printer according to a preferred embodiment of the present invention.

Hereinafter, preferred embodiments of the present invention will be described with reference to the drawings. An inkjet recording device according to a preferred embodiment of the present invention is an inject printer 100 performing printing on a recording paper sheet K as a recording medium. In the following description, the terms "left", "right", "up" and "down" represent left, right, up and down as seen from an operator who is in front of the inkjet printer 100 shown in FIG. 1A. A direction approaching the operator from the inkjet printer 100 is expressed as "forward", and a direction separating from the operator toward the inkjet printer 100 is expressed as "rearward". In the drawings, letters F, Re, L, R, U and D respectively represent front, rear, left, right, up and down. These directions are merely provided for the sake of convenience, and do not limit the form of installment of the inkjet printer 100 in this preferred embodiment in any way. The recording paper sheet K extends in an X direction, which is the left-right direction, and also extends in a Y direction, which is perpendicular to the X direction. It is sufficient that the Y direction is perpendicular to the X direction, and is along a support surface of a flatbed 1 (described below) supporting the recording medium. In the case where, for example, the flatbed 1 is inclining as shown in FIG. 1B, the Y direction is the inclining direction. In the case where the flatbed 1 is located vertical to a horizontal plane, the Y direction is the vertical direction. The X direction corresponds to a first direction, and the Y direction corresponds to a second direction. The above-described recording medium may be another sheet-shaped recording medium, for example, a resin sheet or the like, the recording medium is not limited to being flexible, and may be a hard recording medium such as a glass substrate or the like.

Figure 1B:
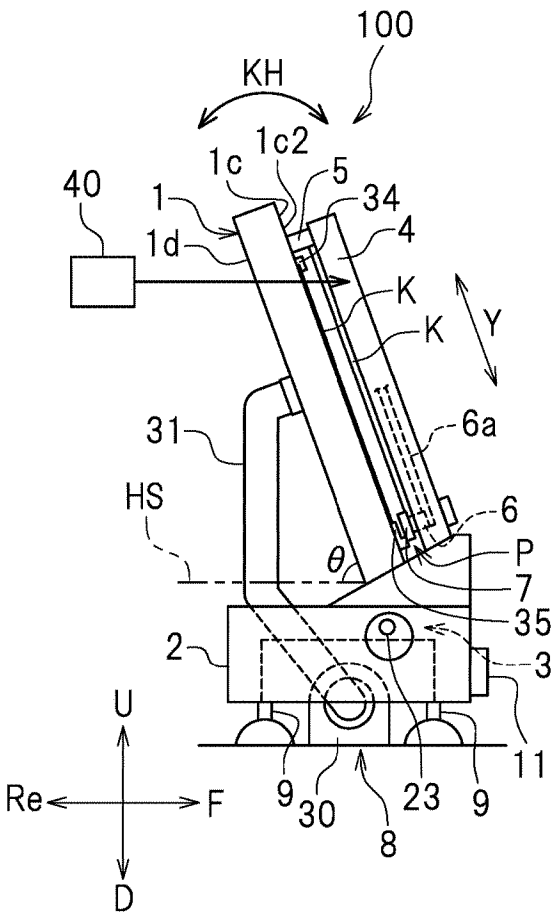
FIG. 1B is a side view of the inkjet printer shown in FIG. 1A.

As shown in FIGS. 1A and 1B, the inkjet printer 100 includes the flatbed 1, which is like a flat plate, a table 2, a pivoting driver 3, a movable member 4, a pair of guide rails 5, a carriage 6, an ink head 7, and a suction generator 8.

Figure 3:
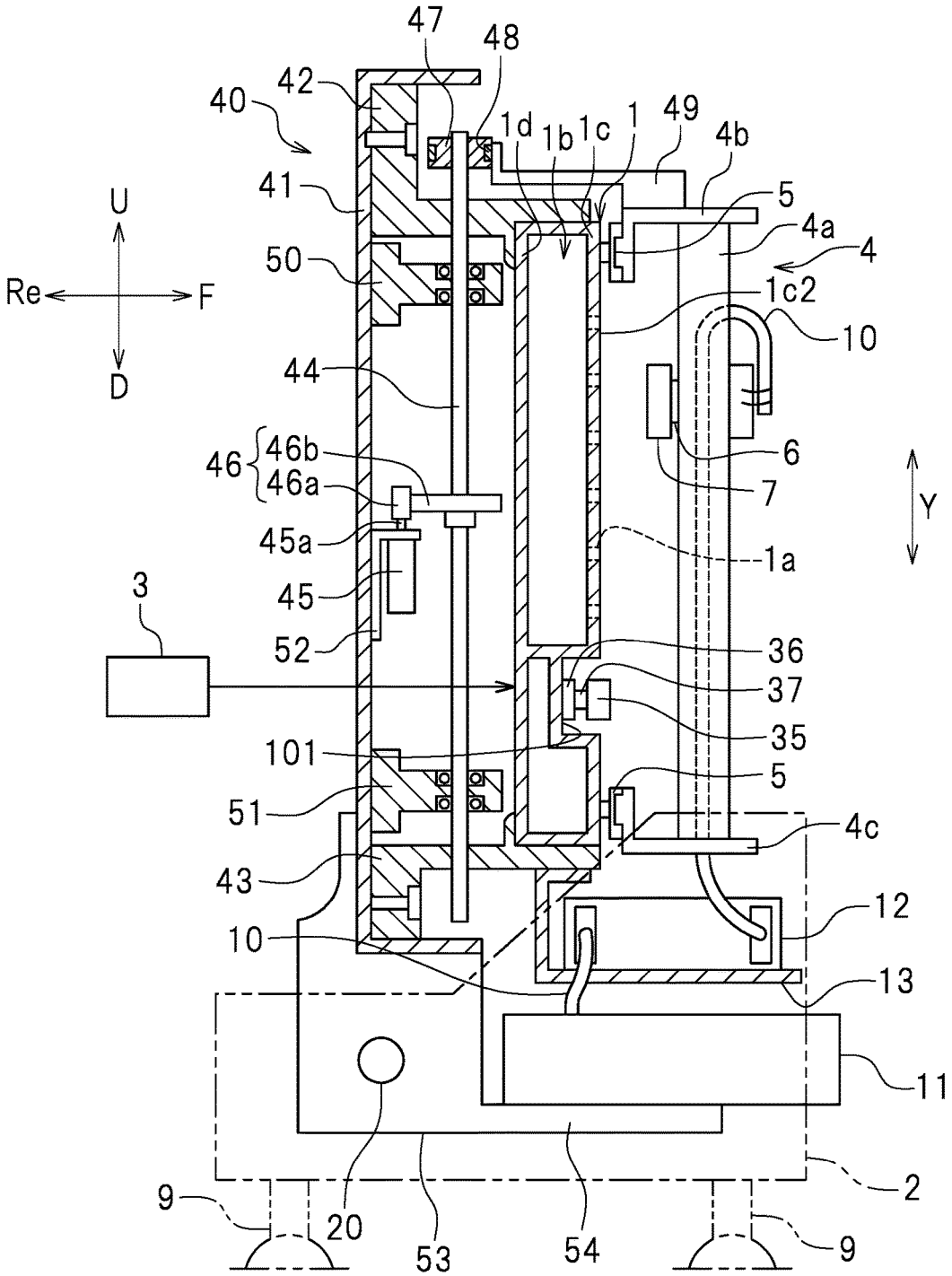
FIG. 3 shows a driver moving a movable member according to a preferred embodiment of the present invention.

As shown in FIG. 1A, the flatbed 1 supports the recording medium K. The flatbed 1 extends in the X direction and also in the Y direction. The flatbed 1 preferably is rectangular or substantially rectangular, for example. In this preferred embodiment, the flatbed 1 has a length in the X direction longer than in the Y direction. The flatbed 1 preferably has a hollow plate structure, for example. The flatbed 1 is provided with an inner space 1*b* (see FIG. 3). The flatbed 1 includes a support plate 1*c* including a support surface 1*c*2 supporting the recording paper sheet K, a rear plate 1*d* located to face the support plate 1*c*, and a plurality of partitions 1*f* dividing the inner space 1*b* into a plurality of divided spaces 1*e*. As shown in FIG. 3, the support plate 1*c* includes a plurality of suction holes 1*a* in communication with the inner space 1*b*. The plurality of suction holes 1*a* are arranged in a lattice pattern. The suction holes 1*a* are each open toward the support surface 1*c*2 of the support plate 1*c*. The partition members 1*f* extend in the Y direction. The partition members 1*f* are provided in the number of, for example, 2. With such a structure, the inner space 1*b* of the flatbed 1 is divided into three divided spaces 1*e* located in the X direction, namely, in the left-right direction. The suction holes 1*a* are in communication with the divided spaces 1*e*. The flatbed 1 is pivoted by the pivoting driver 3. Thus, the flatbed 1 is located parallel or substantially parallel to the horizontal plane HS, or inclined with respect to the horizontal plane HS, or vertical to the horizontal plane HS. In the case where the flatbed 1 is located inclined with respect to the horizontal plane HS, the inclining angle θ is an acute angle. FIGS. 1A and 1B show a state where the flatbed 1 is inclined.

The table 2 is located below the flatbed 1. Four legs 9 supporting the table 2 are located below the table 2. The legs 9 are respectively located at four corners of a bottom surface of the table 4. The table 2 is provided with the pivoting driver 3 pivoting the flatbed 1 in a pivoting direction KH (see FIG. 1B) in order to adjust the angle at which the flatbed 1 is located.

Figure 2:
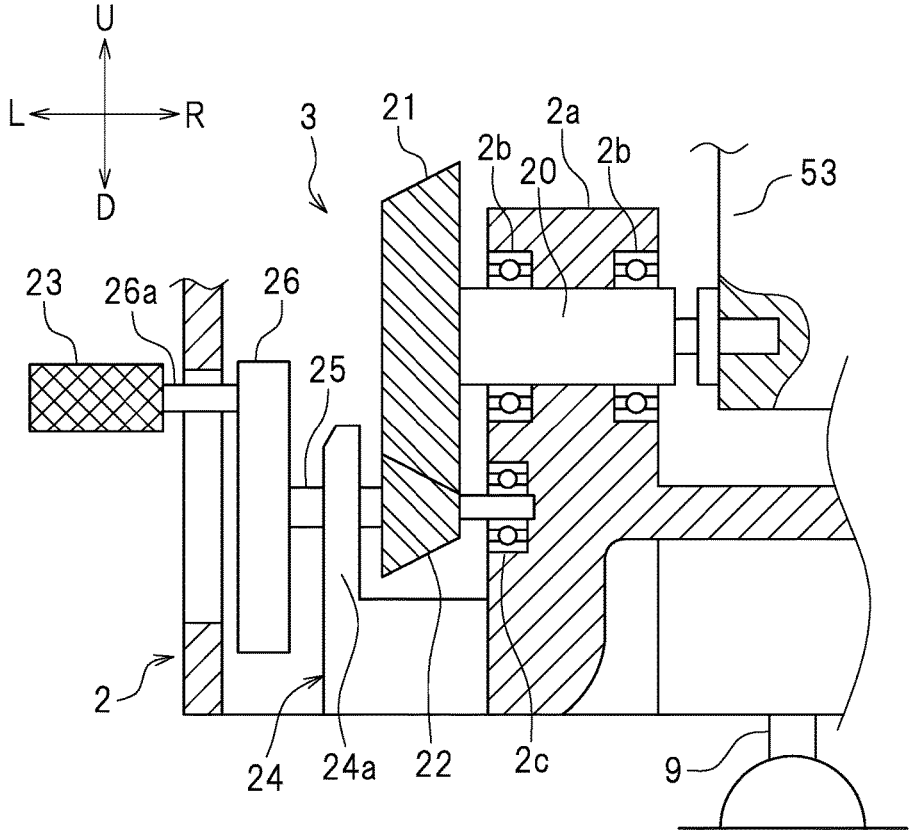
FIG. 2 shows a pivoting driver according to a preferred embodiment of the present invention.

As shown in FIG. 2, the pivoting driver 3 includes a shaft 20, a pivoting gear 21, a driving gear 22, and a handle 23. The shaft 20 extends in a horizontal direction. The shaft 20 is inserted into bearings 2*b* provided in a wall 2*a* of the table 2. One of two ends of the shaft 20 is secured to a housing support 53 by a key or the like. The housing support 53 is secured to a housing 41 described below (see FIG. 3) coupled with the flatbed 1 (see FIG. 1A). The other end of the shaft 20 is connected with the pivoting gear 21. An L-shaped stay 24 is provided on a side surface of the table 2. The stay 24 includes a vertical wall 24*a*. A pivotable shaft 25 is pivotably inserted into the vertical wall 24*a* of the stay 24. One of two ends of the pivotable shaft 25 is inserted into a bearing 2*c* provided in the wall 2*a* of the table 2. The other end of the pivotable shaft 25 is coupled with the handle 23 via an mediating member 26 and a coupling shaft 26*a*. The driving gear 22 is attached to the pivotable shaft 25. The driving gear 22 is engaged with the pivoting gear 21 described above. The gear ratio of the pivoting gear 21 with respect to the driving gear 22 is larger 1. With such a structure, when the operator holds and pivots the handle 23, the driving gear 22 is pivoted via the mediating member 26 and the pivotable shaft 25. Along with the pivoting of the driving gear 22, the pivoting gear 21 is pivoted. When the pivoting gear 21 is pivoted, the shaft 20, which is integral with the pivoting gear 21, is pivoted. Along with the pivoting of the shaft 20, the housing support 53 is pivoted. As a result, the flatbed 1 is pivoted as centered around the shaft 20. In this manner, the flatbed 1 is allowed to assume any of an inclined position, a horizontal position and a vertical position. As described above, the flatbed 1 assumes the inclined position, the horizontal position or the vertical position by an operation made on the handle 23 by the operator. When the flatbed 1 assuming the vertical position is pivoted such that a top end thereof is moved rearward, the flatbed 1 assumes the inclined position or the horizontal position.

The pair of guide rails 5 are provided on the flatbed 1. The pair of guide rails 5 extend in the X direction. One of the guide rails 5 is spaced from the other guide rail 5. The pair of guide rails are equal or substantially equal in length.

As shown in FIGS. 1A and 1B, the movable member 4 extends in the Y direction. The movable member 4 preferably is a movable rail. The movable member 4 is engaged with the pair of guide rails 5. One of two ends of the movable member 4 is engaged with one of the guide rails 5, and the other end of the movable member 4 is engaged with the other guide rail 5. The movable member 4 is slidable on the pair of guide rails 5 to move in the X direction. A driver moving the movable member 4 in the X direction will be described below.

The carriage 6 is provided on the movable member 4. The carriage 6 holds the ink head 7. The carriage 6 is secured to a belt 6*a* provided on the movable member 4. The belt 6 is an endless belt. The belt 6*a* extends in the Y direction. A pulley (not shown) is wound along one of two end portions of the belt 6*a*, and another pulley (not shown) is wound along the other end portion of the belt 6*a*. One of the pulleys is connected with a motor (not shown) driving the pulley. When this motor is rotated, the pulley is rotated and thus the belt 6*a* is driven. Thus, the belt 6*a* runs in the Y direction. This causes the carriage 6 to move in the Y direction. As a result, the ink head 7 held by the carriage 6 is moved in the Y direction.

As shown in FIG. 1A and FIG. 3, the ink head 7 is connected with ink cartridges 11 via ink tubes 10. As shown in FIG. 1A, in this preferred embodiment, four ink cartridges 11 are preferably provided, for example. The ink cartridges 11 respectively contain ink of yellow (Y), magenta (M), cyan (C) and black (K). The ink tubes 10 respectively connected with the ink cartridges 11 are connected with the ink head 7. As shown in FIG. 3, each of the ink tubes 10 is inserted at a middle portion thereof into a bendable ink tube guide 12 provided on the stay 13. As shown in FIGS. 1A and 1B, a wait position (also referred to as a "home position") P of the ink head 7 is a position at which, in the state where the flatbed 1 is located in an inclined state, a bottom end of the ink head 7 is lower than a bottom end of the recording paper sheet K supported by the flatbed 1. The wait position is also located outward relative to one of two ends, in the X direction, of the recording paper sheet K, namely, outward relative to a left end KL of the recording paper sheet K. The wait position P of the ink head 7 may be outward relative to a right end KR of the recording paper sheet K instead of the left end KL of the recording paper sheet K. Ink of any color other than yellow (Y), magenta (M), cyan (C) and black (K) may be used.

As shown in FIG. 1A, the suction generator 8 includes a suction pump 30 and a suction duct 31. One end of the suction duct 31 is connected with the suction pump 30. Other ends of the suction duct 31 are connected with the rear plate 1*d* (see FIG. 1B) of the flatbed 1 and also in communication with the inner space 1*b* (see FIG. 3) of the flatbed 1. In more detail, the suction duct 31 includes three branched ducts 31*a* respectively in communication with the three divided spaces 1*e*. As shown in FIG. 1A, the left branched duct 31*a*, the middle branched duct 31*a* and the right branched duct 31*a* are each provided with a valve 32. The valve 32 is, for example, an electromagnetic valve. With such a structure, in the case where all flow paths are opened by the valves 32, air in all the branched spaces 1*e* is sucked by the suction pump 30. As a result, the recording paper sheet K is sucked and held via the suction holes 1*a* in communication with the divided spaces 1*e*. By contrast, in the case where only a portion of the flow paths is opened by the valve(s) 32, air in a portion of the divided spaces 1*e* is sucked by the suction pump 30. As a result, the recording paper sheet K is sucked and held via only the suction hole(s) 1*a* in communication with the portion of the divided spaces 1*e*.

In this preferred embodiment, as shown in FIG. 1A, the recording paper sheet K is provided in a rolled state and wound around a feed shaft 33. Such a recording paper sheet K is generally called a "roll medium", and is fed from the feed shaft 33 to be supported by the flatbed 1. The feed shaft 33 extends in the Y direction. The feed shaft 33 is provided on a right portion of the flatbed 1. In more detail, the feed shaft 33 is located outward relative to the other end, in the X direction, of the recording paper sheet K supported by the flatbed 1, namely, outward relative to the right end KR of the recording paper sheet K.

Figure 7:
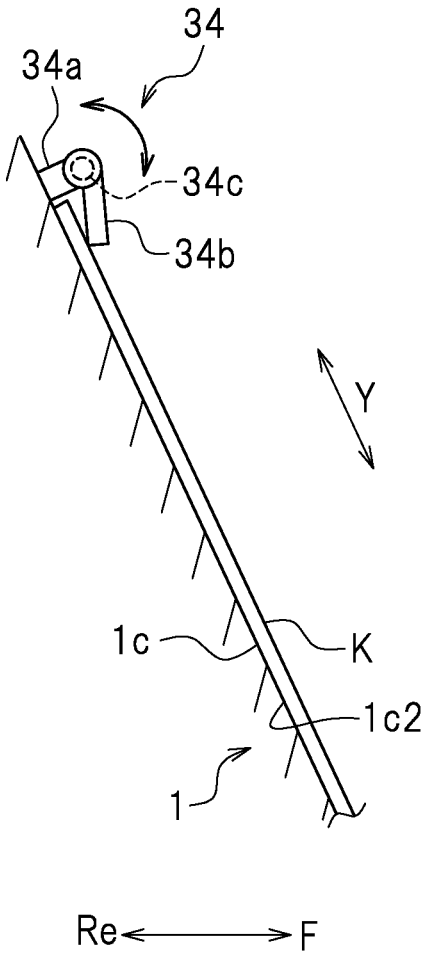
FIG. 7 is a side view of a press according to a preferred embodiment of the present invention.

As shown in FIG. 1A, the flatbed 1 is provided with a plurality of presses 34 that press the recording paper sheet K toward the support plate 1*c* and a plurality of supports 35 supporting an end of the recording paper sheet K. The presses 34 are located at such positions that, in the state where the flatbed 1 is inclined or located vertically, are on a top portion of the flatbed 1. The presses 34 are located with a gap therebetween in the X direction. As each of the presses 34, a hinge, for example, may be adopted that is pivotable between a position at which the hinge presses the recording paper sheet K and a position at which the hinge does not press the recording paper sheet K. In the case where a hinge is used as each of the presses 34, the press 34 includes, as shown in FIG. 7, a main body 34*a* located at such a position that, in the state where the flatbed 1 is inclined or located vertically, is above the top end of the recording paper sheet K supported by the flatbed 1, and also includes a pivotable member 34*b* and a torsion spring 34*c*. The pivotable member 34*b* is provided on the main body 34*a* and is pivotable around a horizontal axis. The pivotable member 34*b* is urged by the torsion spring 34*c* to pivot clockwise in FIG. 7. As a result, the top end of the recording paper sheet K supported by the flatbed 1 is pressed toward the flatbed 1 by the pivotable member 34*b*.

Figure 4:
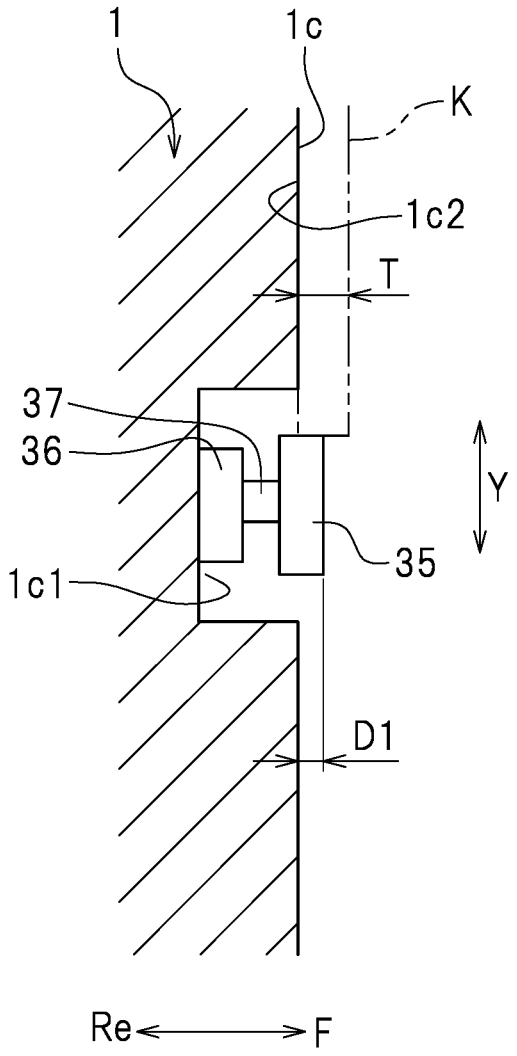
FIG. 4 is a side view of a guide roller defining and functioning as a support according to a preferred embodiment of the present invention.

As shown in FIG. 4, the supports 35 are each, for example, a guide roller. The supports 35 each have a function of being rotated to guide the recording paper sheet K on the flatbed 1 while supporting the end of the recording paper sheet K. The supports 35 are located at such positions that, in the state where the flatbed 1 is inclined or located to have an angle of 90 degrees with respect to the horizontal plane, are on a bottom portion of the flatbed 1. The supports 35 are located with a gap therebetween in the X direction. The support plate 1*c* is provided with a recessed portion 1*c*1. A base member 36 and a shaft member 37 secured to the base member 36 are accommodated in the recessed portion 1*c*1. The supports 35 are connected to the shaft member 37 so as to be rotatable around an axis of the shaft member 37. The supports 35 protrude from the support plate 1*c* of the flatbed 1. Where the protruding height of the supports 35 from the support plate 1*c* is D1 and the thickness of the recording paper sheet K is T, D1 and T have the relationship of D1<T.

Now, a driver 40 that moves the movable member 4 in the X direction will be described. As shown in FIG. 3, the driver 40 includes a housing 41 having a generally C-shaped cross-section, supports 42 and 43 each having an L-shaped cross-section, a pair of shafts 44, a driving motor 45, a gear 46 including a small gear 46*a* and a large gear 46*b*, a pair of pulleys 47, a driving belt 48, and a coupling 49. The shafts 44 are respectively provided on the left portion of, and on the right portion of, the flatbed 1. Similarly, the pulley 47 are respectively provided on the left portion of, and on the right portion of, the flatbed 1.

The housing 41 is located so as to, in the state where the flatbed 1 is located to define an angle of 90 degrees with respect to the horizontal plane, be open forward. The following description on FIG. 3 is made with an assumption that the flatbed 1 is located to define an angle of 90 degrees with respect to the horizontal plane (state shown in FIG. 3). A bottom portion of the housing 41 is secured to the housing support 53 described above. The housing support 53 is provided with a cartridge holder 54 extending forward. The cartridge holder 54 holds the ink cartridges 11. With this structure, when the housing support 53 is pivoted, the ink cartridges 11 are pivoted along with the pivoting of the housing support 53. The support 42 is secured to a top portion of the housing 41. The support 43 is secured to the bottom portion of the housing 41. A front portion of the support 42 is secured to the top portion of the flatbed 1. A front portion of the support 43 is secured to a bottom end of the flatbed 1. A bearing member 50 is provided on the housing 41 and below the support 42. A bearing member 51 is provided on the housing 41 and above the support 43. The shaft 44 extends in the up-down direction. A top portion of the shaft 44 is inserted into the bearing member 50 and also inserted into a hole in the support 42. A bottom portion of the shaft 44 is inserted into the bearing member 51 and also inserted into a hole in the support 43. The other shaft 44 is supported by the same or substantially the same structure.

The small gear 46*a* of the gear 46 is coaxially connected with a rotation shaft 45*a* of the driving motor 45. The large gear 46*b* is engaged with the small gear 46*a*. The large gear 46*b* is coaxially connected with a middle portion of the shaft 44. The driving motor 45 is provided on a stay 52, which is provided on the housing 41. At a top end of the shaft 44, the pulley 47 is provided. The driving belt 48 is an endless belt. The driving belt 48 is extended along, and between, the left pulley 47 and the right pulley (not shown). The movable member 4 includes a main body 4*a* extending in the Y direction and L-shaped slidable members 4*b* and 4*c*. The slidable member 4*b* is secured to a top end of the main body 4*a*. The slidable member 4*c* is secured to a bottom end of the main body 4*a*. The slidable member 4*b* is engaged with the upper guide rail 5 and is slidable on the upper guide rail 5. The slidable member 4*c* is engaged with the lower guide rail 5 and is slidable on the lower guide rail 5. The coupling 49 extends in the front-rear direction. A rear end of the coupling 49 is secured to the driving belt 48. A front end of the coupling 49 is connected with the slidable member 4*b*. With the above-described structure, when the driving motor 45 is rotated, one of the shafts 44 is rotated around an axis thereof via the gear 46. Therefore, the pulley 47 is rotated. This causes the driving belt 47 to run. Along with the running of the driving belt 48, the movable member 4 moves in the X direction (see FIG. 1A) via the coupling 49.

Figure 5:
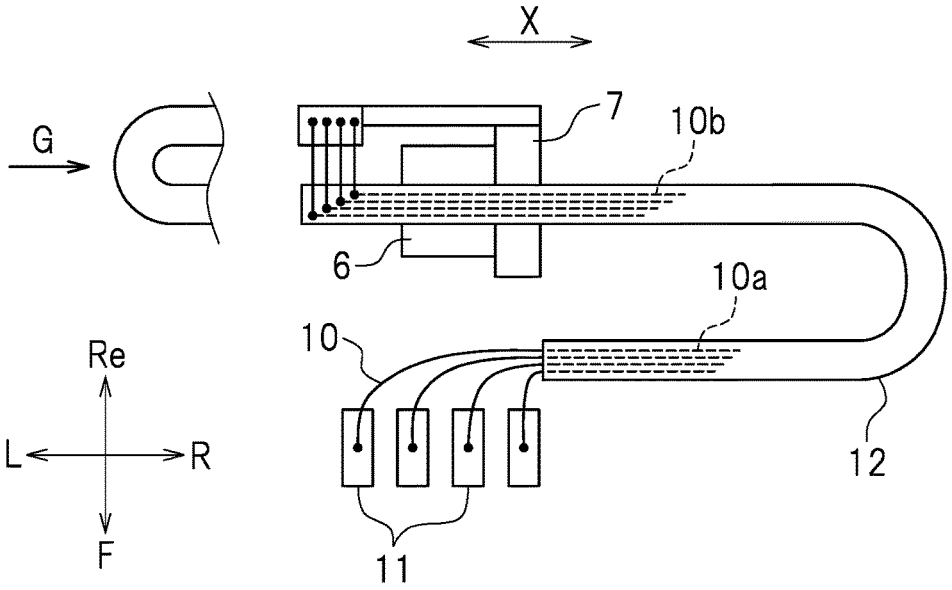
FIG. 5 is a view showing how an ink tube is extended according to a preferred embodiment of the present invention.
Figure 6:
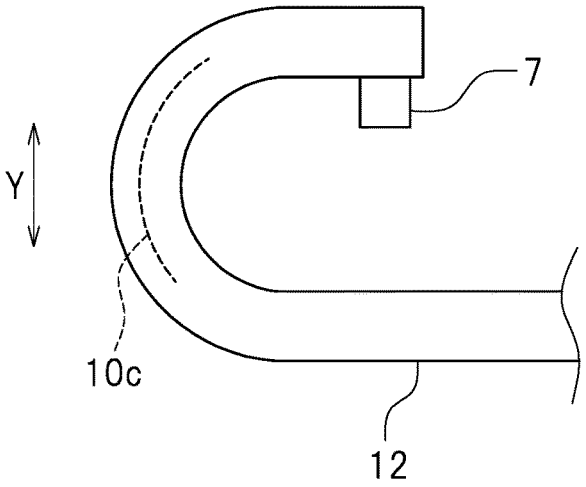
FIG. 6 is another view showing how the ink tube is extended according to a preferred embodiment of the present invention.

FIG. 5 shows one ink tube 10 as seen from below in the state where the flatbed 1 is in the state shown in FIG. 1. FIG. 6 shows the ink tube 10 as seen in the direction of arrow G in FIG. 5 in the case where the flatbed 1 is in the state shown in FIG. 1. As shown in FIG. 5, the ink tube 10 is extended in a U-shape. The ink tube 10 includes a first portion 10*a* extending in the X direction, and a second portion 10*b* facing the first portion 10*a* and extending in the X direction. With such a structure, when the ink head 7 moves in the X direction, the ink tube 10 moves along with the movement of the ink head 7. As shown in FIG. 6, the ink tube 10 includes a third portion 10*c* extending in the Y direction. With such a structure, when the ink head 7 moves in the Y direction, the ink tube 10 moves along with the movement of the ink head 7.

Figure 8A:
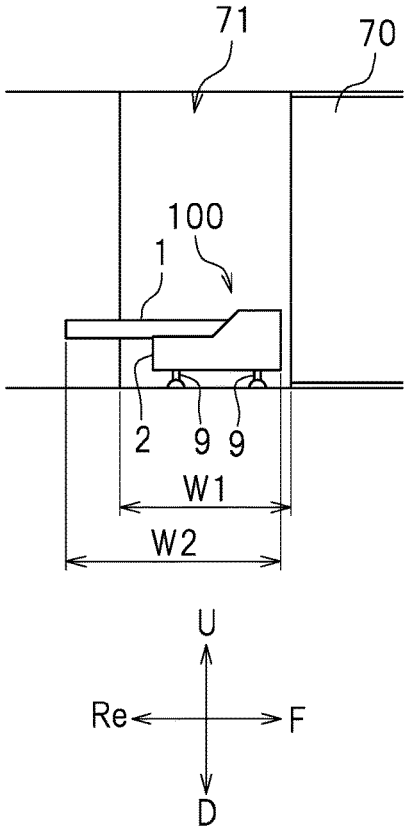
FIG. 8A shows a state where a flatbed according to a preferred embodiment of the present invention that is located horizontally cannot be moved.
Figure 8B:
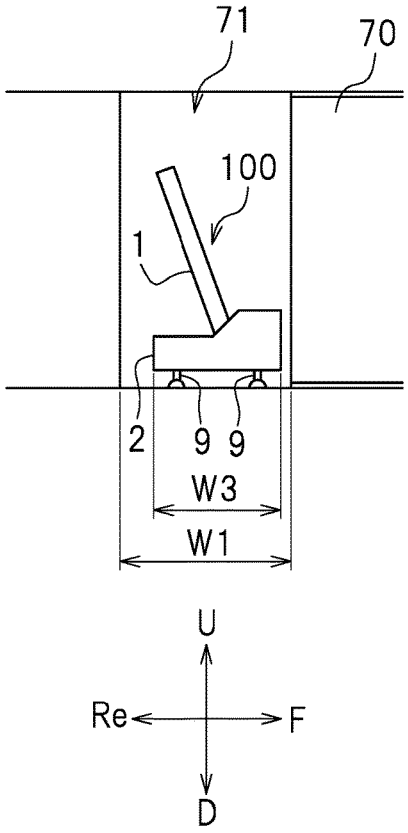
FIG. 8B shows a state where the flatbed inclined with respect to a horizontal plane can be moved.

As described above, in this preferred embodiment, the angle at which the flatbed 1 is located is adjustable by the pivoting driver 3. This allows the flatbed 1 to be located horizontally or located to define a relatively small angle with respect to the horizontal plane to set the recording paper sheet K to the flatbed 1. Therefore, the recording paper sheet K is easily set. This prevents the recording paper sheet K from being warped when the recording paper sheet K is set, and thus the printing quality is not lowered. For moving the inkjet printer 100 through a small space, the flatbed 1 may be inclined or located vertically to decrease the width of the inkjet printer 100 (i.e., the length thereof in the front-rear direction). This will be described specifically. As shown in FIG. 8A, the width of an entrance 71 with a door 70 being opened is W1, and the width of the inkjet printer 100 in the state where the flatbed 1 is located horizontally (i.e., the length thereof in the front-rear direction) is W2. In the case where W2>W1, the inkjet printer 100 cannot pass the entrance 71 in the state shown in FIG. 8A. As shown in FIG. 8B, the width of the inkjet printer 100 in the state where the flatbed 1 is inclined (i.e., the length thereof in the front-rear direction) is W3. In this case, W3<W1. This allows the inkjet printer 100 to pass the entrance 71. As described above, the width of the inkjet printer 100 may be decreased and thus the ease of movement is improved. In addition, the recording paper sheet K may be located at an appropriate angle in accordance with the recording paper sheet K, specifically, in accordance with the hardness of the recording paper sheet K. Therefore, when, for example, the recording paper sheet K is to be set on the flatbed 1 inclined at a relatively large angle, the recording paper sheet K, even if being easily bendable, is prevented from coming off from the flatbed 1.

In this preferred embodiment, the carriage 6 is provided on the movable member 4 so as to be movable in the Y direction. The movable member 4 moves on the guide rails 5 in the X direction. With such a structure, the ink head 7 is allowed to move in two directions with respect to the recording paper sheet K supported by the flatbed 1. Namely, the ink head 7 is movable two-dimensionally with respect to the recording paper sheet K, and thus ink is allowed to be injected toward any position on the recording paper sheet K.

In this preferred embodiment, the home position of the ink head 7, namely, the wait position of the ink head 7, is set such that, in the state where the flatbed 1 is located to define an angle of 90 degrees with respect to the horizontal plane, the bottom end of the ink head 1 is lower than the bottom end of the recording paper sheet K supported by the flatbed 1, and is also set to be outward relative to the left end KL of the recording paper sheet K. Therefore, to set the recording paper sheet K to the flatbed 1 inclined or vertical with respect to the horizontal plane, the recording paper sheet K is easily set from above the flatbed 1.

In this preferred embodiment, the ink tubes 10 each include the first portion 10*a* extending in the X direction and the second portion 10*b* facing the first portion 10*a* and extending in the X direction. The ink tubes 10 each further include the third portion 10*c* extending in the Y direction. With such a structure, when the ink head 7 is moved in two directions, namely, in the X direction and the Y direction, the ink tube 10 is easily moved along with the movement of the ink head 7.

In this preferred embodiment, a so-called roll medium is usable as the recording paper sheet K. The position of the feed shaft 33 around which the recording paper sheet K, which is the roll medium, is wound may be set to be outward relative to the right end KR of the recording paper sheet K supported by the flatbed 1, so that a space outward relative to the right end KR is effectively usable.

In this preferred embodiment, the recording paper sheet K supported by the flatbed 1 is sucked by the suction pump 30 via the suction holes 1*a* and the suction duct 31. This prevents the recording paper sheet K from being positionally shifted with respect to the flatbed 1. Especially in the state where the recording paper sheet K is supported by the flatbed 1 inclined or vertical with respect to the horizontal plane, the recording paper sheet K is prevented from falling down or coming off.

In this preferred embodiment, the suction duct 31 is connected with the rear plate 1*d* of the flatbed 1. Therefore, in the state where the flatbed is inclined or vertical with respect to the horizontal plane, a dead space at the rear of the rear plate 1*d* is effectively usable.

In this preferred embodiment, the flow paths in the branched ducts 31*a* respectively in communication with the divided spaces 1*e* of the flatbed 1 are opened or closed by the valves 32. This allows the air to flow into all the branched ducts 31*a* and thus allows the air to be fed into the entirety of the inner space 1*b* of the flatbed 1. Therefore, the recording paper sheet K, even being supported by the flatbed 1 vertical with respect to the horizontal plane or inclined, is held by a sufficient level of suction force. By contrast, it may be arranged such that the air flows into only a portion of the branched ducts 31*a*. Therefore, in the case where the recording paper sheet K to be sucked has a smaller area size than that of the flatbed 1, the air merely needs to be fed into a portion of the branched ducts 31*a*. This decreases the power consumption of the suction pump 30.

In this preferred embodiment, the bottom end of the recording paper sheet K is supported by the supports 35. This allows the position of the recording paper sheet K with respect to the flatbed 1 to be set easily.

In this preferred embodiment, the guide rollers are adoptable as the supports 35. The end of the recording paper sheet K is supported by the guide rollers. This allows the recording paper sheet K to be moved easily, and allows the position of the recording paper sheet K with respect to the flatbed 1 to be set more easily.

In this preferred embodiment, the protrusion height of the supports 35 from the support plate 1*c* is smaller than the thickness of the recording paper sheet K. This decreases the possibility that when recording is performed on the recording paper sheet K, the ink head 7 contacts the supports 35.

In this preferred embodiment, the pivoting driver 3 pivots the flatbed 1 between a state where the flatbed 1 is horizontal and a state where the flatbed 1 is vertical. This reduces the pivoting angle of the flatbed 1 preferably to a minimum possible level that improves the ease of locating the recording paper sheet K on the flatbed 1 and the ease of movement of the inkjet printer 100.

In this preferred embodiment, the operator is allowed to easily adjust the angle at which the flatbed 1 is located by operating the handle 23.

Preferred embodiments of the present invention have been described. The above-described preferred embodiment is merely illustrative, and the present invention may be carried out in any of various other preferred embodiments, for example, as follows.

Figure 9A:
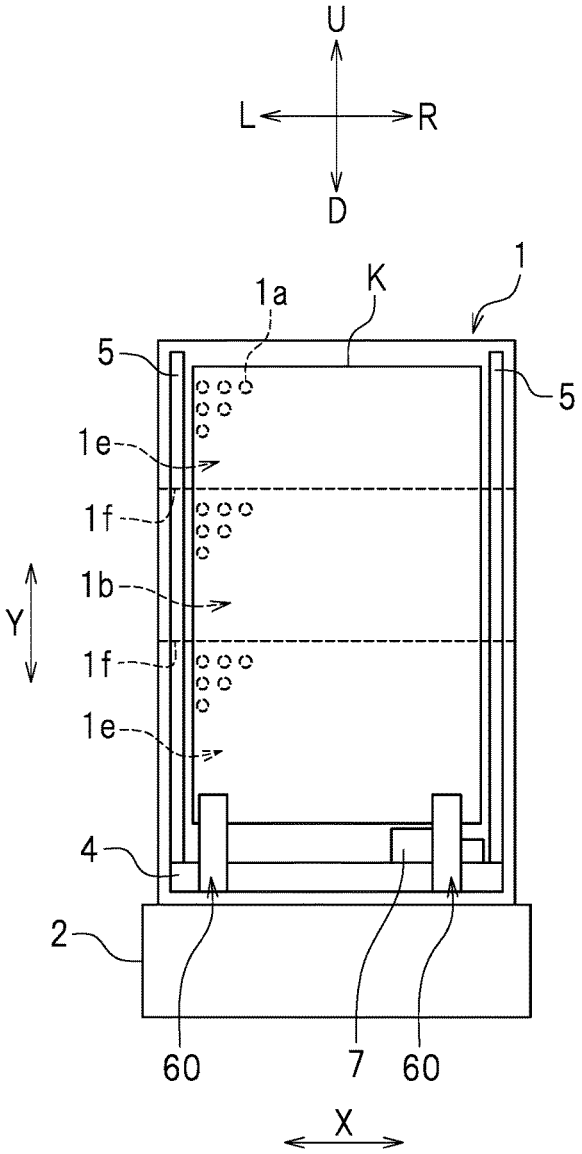
FIG. 9A is a front view of an inkjet printer according to a preferred embodiment of the present invention.
Figure 9B:
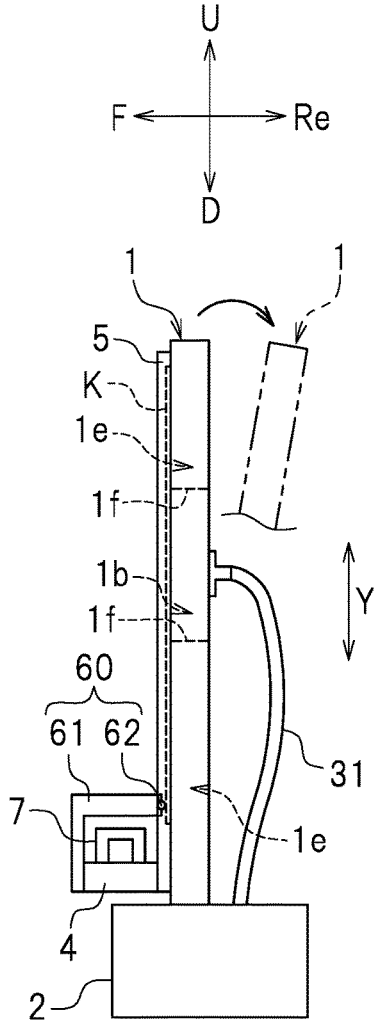
FIG. 9B is a side view of the inkjet printer shown in FIG. 9A.

In the above-described preferred embodiments, the guide rails 5 preferably are provided in the X direction and the movable member 4 preferably is moved in the X direction. The present invention is not limited to this. As shown in FIG. 9A, the guide rails 5 may be provided in the Y direction and the movable member 4 may be moved in the Y direction. In this case, the movable member 4 may be provided with a press 60 that presses the recording paper sheet K in a thickness direction thereof. The press 60 includes an L-shaped support 61 secured to the movable member 4 and a press ball 62 provided on the support 61. The press ball 62 contacts the recording paper sheet K to press the recording paper sheet K to the flatbed 1. This allows the recording paper sheet K to be easily held on the flatbed 1 at the time of printing. Therefore, the printing quality is prevented from being lowered, and the recording paper sheet K is prevented from being warped. The possibility that the recording paper sheet K in a warped state damages the ink head 7 is decreased, and thus the productivity is improved. FIG. 9A and FIG. 9B show a state where the flatbed 1 is located to define an angle of 90 degrees with respect to the horizontal plane.

In the above-described preferred embodiments, the presses 34 preferably are located at such positions that, in the state where the flatbed 1 is inclined or located vertically with respect to the horizontal plane, are on the top portion of the flatbed 1. The present invention is not limited to this. The presses 34 may be provided on a left portion or a right portion of the flatbed 1.

In the above-described preferred embodiments, the plurality of presses 34 preferably are provided. The present invention is not limited to this. A single press extending in the X direction may be adopted.

In the above-described preferred embodiments, the pivoting gear 21 and the driving gear 22 are preferably provided as a combination of gears transmitting a rotation force of the handle 23. The present invention is not limited to this. The rotation force of the handle 23 may be transmitted to the shaft 20 via, for example, a worm gear.

In the above-described preferred embodiments, the inner space 1*b* of the flatbed 1 is preferably divided into three divided spaces 1*e*, for example. The present invention is not limited to this. The inner space 1*b* of the flatbed 1 may be divided into four or more divided spaces 1*e*, or the inner space 1*b* may not be divided.

In the above-described preferred embodiments, as shown in FIG. 3, the pulleys 47 are preferably provided at only the top ends of the shafts 44 and the movable member 4 is moved by the driving belt 48. The present invention is not limited to this. Pulleys 47 may be provided also at bottom ends of the shafts 44 and another driving belt 48 may be extended along, and between, such pulleys 47. A bottom portion of the movable member 4 may be coupled with the another driving belt 48. Such a structure allows the movable member 4 to move more stably by the two driving belts 48.

In the above-described preferred embodiments, the suction holes 1*a* preferably are located regularly. The present invention is not limited to this. The suction holes 1*a* may be provided irregularly.

In the above-described preferred embodiments, the feed shaft 33 around which the recording paper sheet K as the roll medium is wound preferably is provided outward relative to the right end KR of the recording paper sheet K supported by the flatbed 1. A wind-up device that winds up the recording paper sheet K may be provided outward relative to the left end KL of the recording paper sheet K.

In the above-described preferred embodiments, the guide rails 5 preferably are provided on the flatbed 1. The present invention is not limited to this. The guide rails 5 may be provided at any other positions than on the flatbed 1.

In the above-described preferred embodiments, the pair of guide rails 5 preferably extend in the X direction and the movable member 4 extends in the Y direction. The present invention is not limited to this. The pair of guide rails 5 may extend in the Y direction and the movable member 4 may extend in the X direction.

The above-described preferred embodiments and the modifications may be appropriately combined.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet recording device, comprising:

a bed that supports a recording medium and extends in a left-right direction and an up-down direction perpendicular or substantially perpendicular to the left-right direction, the bed being inclined with respect to a horizontal plane and a vertical plane;

an ink head that injects ink toward the recording medium;

a movable member extending in the up-down direction and being located forward of the bed;

a carriage that holds the ink head and is provided on the movable member so as to be movable in the up-down direction;

a coupling including a first end and a second end, the coupling extending in a front-rear direction and being located above the bed; and a driving belt located rearward of the bed; wherein the first end of the coupling is connected to the movable member and the second end of the coupling is connected to the driving belt.

2. The inkjet recording device according to claim 1, further comprising:

a pair of guide rails extending in the left-right direction; wherein the movable member is engaged with the pair of guide rails and slidable on the pair of guide rails to be movable in the left-right direction.

3. The inkjet recording device according to claim 1, wherein a wait position of the ink head is a position at which a bottom end of the ink head is lower than a bottom end of the recording medium supported by the bed and is a position outside of one of two ends, in the left-right direction, of the recording medium.

4. The inkjet recording device according to claim 1, further comprising:

an ink tube coupled with the ink head; wherein the ink tube includes a portion extending in the left-right direction and a portion extending in the up-down direction.

5. The inkjet recording device according to claim 1, further comprising:

a feed shaft around which the recording medium is wound in a rolled state; wherein the feed shaft is outside of one of two ends, in the left-right direction, of the recording medium supported by the bed.

6. The inkjet recording device according to claim 1, further comprising a press that is provided on the movable member and presses the recording medium in a thickness direction of the recording medium.

7. The inkjet recording device according to claim 1, wherein the bed is provided with an inner space that is divided;

the bed includes a support plate that supports the recording medium and is provided with a plurality of suction holes in communication with the inner space; and the inkjet recording device further comprises a suction pump including a suction duct in communication with the inner space.

8. The inkjet recording device according to claim 7, wherein the bed includes a rear plate facing the support plate; and the suction duct is connected with the rear plate.

9. The inkjet recording device according to claim 7, wherein the bed includes one or a plurality of partition members that divide the inner space into a plurality of divided spaces;

the suction duct includes a plurality of branched ducts respectively in communication with the plurality of divided spaces; and the inkjet recording device further comprises a valve that opens or closes a flow path in each of the plurality of branched ducts at a branch point of each of the plurality of branched ducts.

10. The inkjet recording device according to claim 1, further comprising a support that is located below the bed or at a bottom portion of the bed to support a bottom end of the recording medium.

11. The inkjet recording device according to claim 10, wherein the bed includes a surface that supports the recording medium; and the support protrudes from the surface of the bed.

12. The inkjet recording device according to claim 11, wherein the support has a protrusion height from the surface of the bed that is less than a thickness of the recording medium.

13. The inkjet recording device according to claim 10, wherein the support includes a guide roller.

* * * * *